US005556135A

United States Patent [19]

Duncan

[11] Patent Number: 5,556,135

[45] Date of Patent: Sep. 17, 1996

[54] SCORE CARD

[76] Inventor: Marvin G. Duncan, 1807 SE. Miller St., Portland, Oreg. 97202

[21] Appl. No.: 358,817

[22] Filed: Dec. 19, 1994

[51] Int. Cl.[6] ..... A42B 1/24

[52] U.S. Cl. ..... 283/48.1; 2/195.1; 2/209.13

[58] Field of Search ..... 2/195.1, 209.13; 40/329; 283/48.1

[56] References Cited

U.S. PATENT DOCUMENTS

| | | | |
|---|---|---|---|
| 80,352 | 7/1868 | Imbach et al. | 2/195.1 X |
| 236,664 | 8/1882 | Pennock | 40/329 |
| 448,266 | 3/1891 | Schneider | 40/329 |
| 847,809 | 3/1907 | Ollard | 2/209.13 |
| 1,163,054 | 12/1915 | Williams | 40/329 X |
| 1,616,669 | 2/1927 | Rabert | 40/329 X |
| 2,337,023 | 12/1943 | Akana | 40/329 |
| 4,914,755 | 4/1990 | Motley | 2/209.13 X |
| 5,129,103 | 7/1992 | Gruneison | 2/195 X |
| 5,253,368 | 10/1993 | Blake | 40/329 X |
| 5,410,761 | 5/1995 | Connelly et al. | 2/195.1 |
| 5,428,842 | 7/1995 | Wise | 2/195.1 |
| 5,452,479 | 9/1995 | Mostert | 2/209.13 X |

*Primary Examiner*—Frances Han

*Attorney, Agent, or Firm*—Eugene M. Eckelman

[57] ABSTRACT

A score card has a front surface including scoring areas for scores to be entered thereon as well as game information and directions for entering the scores in the scoring areas. The score card has a pressure sensitive non-drying adhesive on the rear surface that allows the score card to be temporarily attached to the undersurface of the bill of a hat. The score card can be shaped similar to the shape of the hat bill in order to take advantage of as much space on the card as possible.

3 Claims, 1 Drawing Sheet

SCORE CARD

BACKGROUND OF THE INVENTION

This invention relates to new and useful improvements in score cards.

Golf players carry a score card which is desired to be kept handy for posting the scores as the holes are played. Usually, the card is kept in a pocket of the golfer's clothes and sometimes it is kept on a cart for the clubs. Getting the card in and out of the pocket or off the cart is frequently difficult, particularly during foul weather. Many times, the cards are ruined or made illegible by creasing thereof or by getting wet from rain.

SUMMARY OF THE INVENTION

It is an object of the invention to provide a score card having means for temporarily attaching it to the underside of the bill of a hat whereby scoring can be made simply by removing the hat and turning it over for writing on the card, thus protecting the card and also making it readily available for entering scoring.

It is also an object of the invention to provide such means for keeping score for any type of sport as long as a hat is worn that has a bill to which the card can be attached.

The invention is performed by providing a score card with a pressure sensitive non-drying adhesive on its rear surface that allows the card to be temporarily stuck to the undersurface of the bill of the hat. Preferably, the card is shaped similar to the shape of the bill of the hat which in most cases is generally crescent shaped whereby to provide as much room on the card as possible.

DETAILED DESCRIPTION OF A PREFERRED EMBODIMENT

Figure 1:
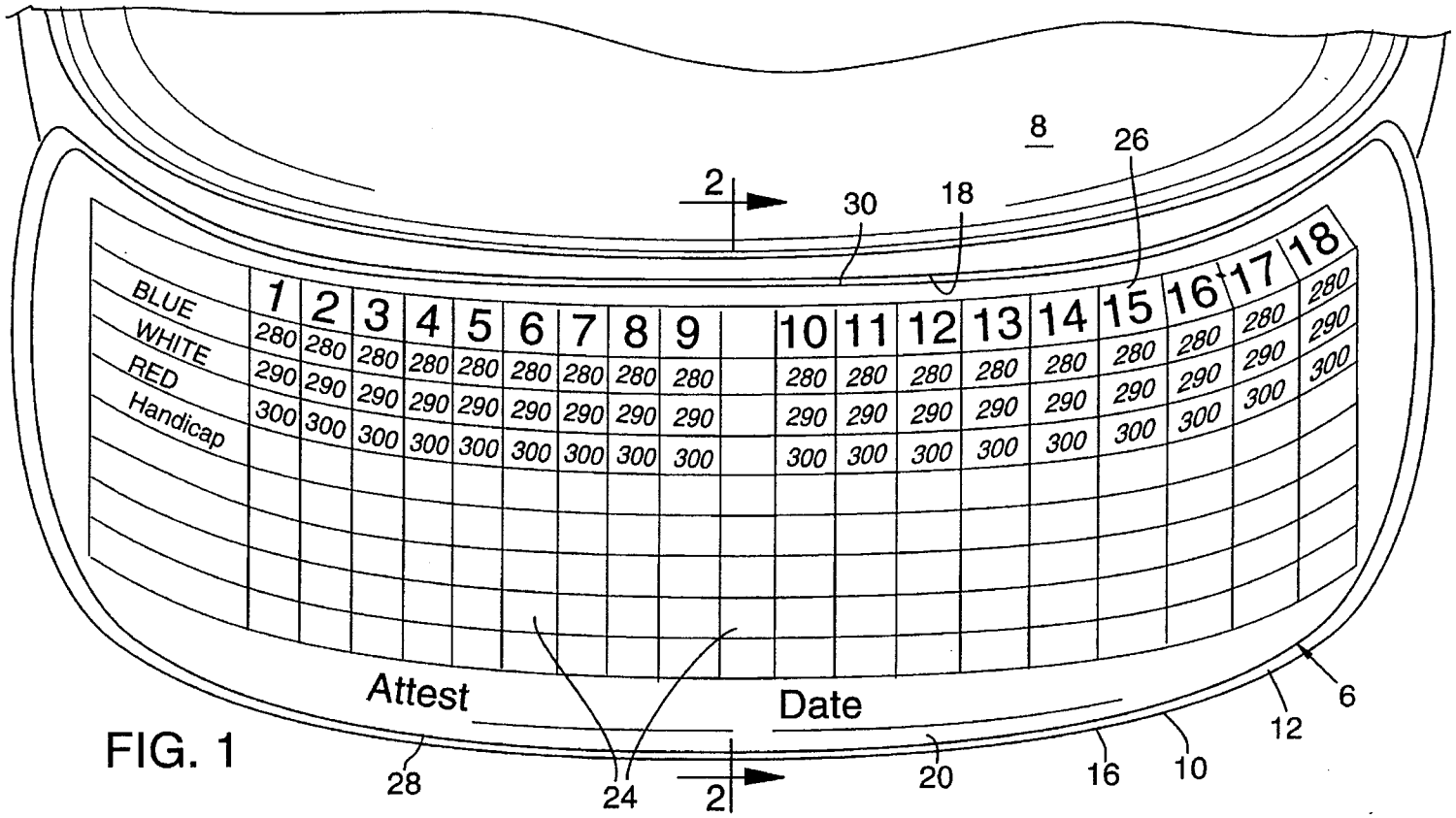
FIG. 1 is a plan view of the undersurface of the bill of a hat and showing the present score card adhesively attached thereto.
Figure 2:
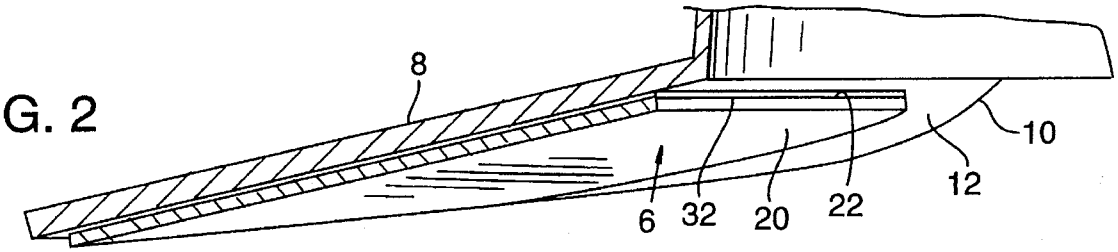
FIG. 2 is a fragmentary sectional view taken on the line 2—2 of FIG. 1.

The present invention relates generally to score cards and in particular a score card 6 that is attachable to a hat. The card shown is a golf score card but it is to be understood that the card could as well be used for other sports such as basketball, baseball, football, soccer, etc. Commonly, many players or spectators wear a hat 8 having a front bill 10 that is 3 or 4 inches long and has a smooth, uninterrupted lower surface 12. The bill of the hat assumes roughly a crescent shape with front and rear convex-concave edges 16 and 18, respectively.

The score card of the invention comprises front and rear surfaces 20 and 22, respectively. The front surface has scoring areas or blanks 24 and the necessary game information and directions 26 for entering the scores in the scoring areas. Preferably the card has a crescent shape similar to the shape of the bill, namely, it has front and rear concex concave edges 28 and 30, respectively. Also preferably, the card is substantially as large as the bill of the hat so as to make as large a scoring area as is possible.

The rear surface 22 of the card is provided with a layer or coating of pressure sensitive adhesive 32 that is non-drying and capable of removably adhering to the lower surface 12 of the bill of the hat. For marketing, the card has a thin protective overlay sheet over the adhesive. Such sheet will be removed when the card is put to use. Such an overlay protective sheet is not shown herein and is commonly used on pressure sensitive non-drying adhesive products.

Thus, to use the card of the invention, the adhesive protective overlay sheet is removed and the card attached to the lower surface of the bill of the hat. The card is mounted selectively to best fit on this lower surface, namely, preferably to match the crescent shape of the bill. For entering a score on the card it is merely necessary to remove the hat from the head and invert it for presenting the card for scoring. The bill of this type of hat is stiff and thus forms a good firm backing surface for writing on the card. The card is protected by its mounted position on the undersurface of the bill of the hat and will be better preserved than if it were moved into and out of pockets and repeatedly folded or clipped to a golf cart.

As stated, the card can be used for many sports. For other than golf, the scoring surface of the card includes the necessary scoring areas and the game information and directions to be scored.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. In combination with a hat having a front bill of stiff material comprising a firm supporting lower surface, a score card having opposite surfaces one surface of which is printed with scoring indicia, and a pressure sensitive adhesive on the surface opposite the surface printed with scoring indicia, the pressure sensitive adhesive removably attaching the score card to the lower surface of the stiff front bill of the hat, whereby to enable writing a score on the surface of the score card printed with scoring indicia.

2. The combination of claim 1 wherein the front bill of the hat is shaped with a rounded front edge and the score card is provided with a front edge substantially matching the rounded front edge of the front bill of the hat.

3. The combination of claim 1 wherein the front bill of the hat is of crescent shape and the score card has front and rear edges curved to form a crescent shape substantially matching the crescent shape of the front bill of the hat.

* * * * *